US005628617A

United States Patent [19]

Dalton et al.

[11] Patent Number: 5,628,617

[45] Date of Patent: May 13, 1997

[54] EXPANDING BELL SEAL

[75] Inventors: William S. Dalton, Chesterfield; James J. Kosiba, South Hadley; K. Scott Trunkett, Springfield, all of Mass.

[73] Assignee: Demag Delavel Turbomachinery Corp. TurboCare Division, Chicopee, Mass.

[21] Appl. No.: 694,444

[22] Filed: Aug. 12, 1996

[51] Int. Cl.[6] ..... F01D 25/26

[52] U.S. Cl. ..... 415/134; 277/26; 277/174

[58] Field of Search ..... 415/170.1, 134, 415/136; 277/22, 26, 35, 44, 173, 174

[56] References Cited

U.S. PATENT DOCUMENTS

| | | | |
|---|---|---|---|
| 2,527,446 | 10/1950 | Jenks, Jr. et al. . | |
| 3,746,463 | 7/1973 | Stock et al. | 415/136 |
| 3,907,308 | 9/1975 | Stock | 277/72 R |
| 4,697,983 | 10/1987 | Yamaguchi | 415/134 |
| 4,702,671 | 10/1987 | Brinkman et al. | 415/134 |
| 4,772,178 | 9/1988 | Miller | 415/177 |
| 4,802,679 | 2/1989 | Chen et al. | 277/12 |
| 4,812,105 | 3/1989 | Heymann | 415/134 |
| 4,850,794 | 7/1989 | Reynolds, Jr. et al. | 415/136 |
| 5,037,115 | 8/1991 | Brandon | 277/26 |
| 5,037,269 | 8/1991 | Halberg | 415/134 |
| 5,433,453 | 7/1995 | Dalton | 415/136 |
| 5,520,398 | 5/1996 | Brandon | 415/134 |

*Primary Examiner*—John T. Kwon

*Attorney, Agent, or Firm*—Ross, Ross & Flavin

[57] ABSTRACT

In a steam turbine having a main inlet pipe which introduces steam to a nozzle chamber through the turbine casings and a bell seal assembly for sealing the inlet pipe relative to the casings and the nozzle chamber, the bell seal assembly including a bell seal disposed in the nozzle chamber, and a retainer nut sleeved by the bell seal and threadedly engaged in the inlet pipe, the improvement which comprises: the bell seal being replaced by a ring carrier, a stack of inner and outer sealing rings loosely sleeved on the ring carrier, the material of the inner rings having a lower coefficient of thermal expansion than the material of the ring carrier and the outer rings being made from a material having a higher coefficient of thermal expansion than the material of the nozzle chamber.

5 Claims, 3 Drawing Sheets

EXPANDING BELL SEAL

BACKGROUND OF THE INVENTION

1. Field of the Invention

The invention relates to steam turbine bell seals for sealing the main inlet pipe which introduces steam to the nozzle chamber through the turbine casings.

2. Description of the Prior Art

In steam turbines, it is necessary to provide a sealed passage for steam between the separate casings of the unit. This is accomplished either by inlet pipes or snouts surrounded by a series of seal rings, or, as in the case of certain turbines, by a bell seal. Since the casings have different rates and magnitudes of thermal expansion these seals must be capable of accepting vertical, axial and transverse differential expansion relative to the axis of the turbine shaft, without permitting significant leakage.

The main elements of a prior art bell seal assembly are the bell seal, a retainer nut, and a locking screw. In conventional designs, the bell seal is made of stellite material with the nut, locking screw, inlet sleeve and nozzle chamber neck made of CR/MO steel.

In the steam path of the turbine, maintaining efficiency is dependent on the tightness of the seals. The tighter the seals, the more efficient is the turbine. Bell seals are no exception. They must be able to move and accommodate the normal expansion and contraction that takes place as units heat up and cool down. However, when the units are taken apart, in most instances it is found that the bell seals are either cracked, distorted or "frozen" in place, leading to difficulty with disassembly, excess clearances, increased steam leakage, and decreased turbine efficiency due to a high buildup of iron oxide.

As temperatures in excess of 700° F. are reached, a thin layer of oxide buildup forms on all ferritic material surfaces. This layer can sometimes be in excess of 0.010" thick and interferes with the tight radial and axial clearances required in the bell seal assembly. For instance, as the oxide layer forms on the retaining nut, it quickly takes up the axial clearance between the nut and the bell seal, locking the bell seal in place. When differential expansion occurs, the seal cannot move, creating undue stresses on the assembly and distortion and stretching of parts leading to steam leakage. To further complicate matters, if particulate material is contained in the steam coming from the boilers, erosion takes place on steam inlet components resulting in costly repairs. In some cases, the bell seal becomes so locked up that it must be destroyed during disassembly, creating expensive and difficult replacement.

The purpose of a bell seal is to seal the area between the steam inlet pipe and the nozzle area. Steam is flowing through this cavity at a temperature of approximately 1000° F. and at a pressure of approximately 3500 lbs. Psi. This system allows for 0.25 to 0.5 percent leakage between the seal and the inlet pipe. The reason for this leakage is to allow for assembly of the components, that is, there is a 0.002 to 0.003 clearance between the seal and the inlet pipe. More clearance, which would be preferable to improve ease of assembly and freedom of movement in operation, would allow much greater leakage which is detrimental to the turbine efficiency. There is also a 0.003 to 0.004 clearance by design between the nut and the bell seal. This clearance is to allow for radial movement between the nozzle chamber and the inlet pipe that occurs because of the thermal transits during start up of the turbine. The events that occur when the two pipes are at ambient temperature of 68° F. and are suddenly exposed to a temperature approximately 1000° F. and a pressure of approximately 3500 lbs. Psi cause significant thermal transits between the two pipes. The nut used to attach the bell seal to the inlet pipe is made from CR/MO. Although this material has adequate strength, it is highly susceptible to oxide buildup, thus making it impossible or nearly impossible to remove it by unscrewing in the normal fashion. The nut in most cases must be cut out, a very difficult and time consuming process. The bell seal is manufactured from Stellite-6 which is a highly erosion resistant and tough material. The nozzle chamber is made from CR/MO which is a relatively soft and malleable steel and susceptible to oxide buildup. After operating in a harsh environment for several years the seals are very difficult to separate without galling the nozzle box during disassembly. When galling does occur it becomes necessary to machine the nozzle chamber, a very time consuming and expensive operation.

To summarize the problems described above:

- small assembled clearances, which makes disassembly/reassembly difficult and restricts differential movement between major turbine components;
- high oxidation rates which promote binding between the seal area;
- high oxidation rates which promote binding between the nut and the inlet pipe not allowing the parts to move relative to each other;
- high coefficients of friction that can damage the tight seal area and restrict movement;
- the bell seal, the locking nut, and the nozzle chamber are often destroyed or damaged during disassembly; and
- the designed leakage between bell seal and the nozzle chamber.

SUMMARY OF THE INVENTION

The expanding bell seal of the invention replaces the prior art bell seal assembly described above and, in one embodiment, employs a single unit incorporating the nut and ring carrier as a single entity, with the ring carrier supporting a stack of inner and outer rings, with the inner diameter of the inner rings embracing the outer diameter of the ring carrier and the outer diameter of the outer rings embracing the inner diameter of the inlet passage.

Deflection results give an idea about the amount of radial growth the ring carrier undergoes as well as the relative axial motion which may not occur in reality since both the top edge of the inlet pipe and the bottom edge of the nozzle chamber are prevented from moving in that direction. The relative radial growth between the carrier and inner rings and between the outer rings and the inlet passage is totally dependent on the difference between their materials' coefficient of thermal expansion and their temperature distribution. A high room temperature initial gap is desirable for ease of assembly and freedom of movement at transient temperature conditions.

Stress results show that the inner seal rings are clearly loaded in tension in the hoop direction. The major contribution to this stress comes from contact loads transmitted by the ring carrier. The hoop stress in the second and third outer seal rings indicates the same effect from the nozzle chamber while in compression. The first outer seal ring does not only see the compressive contact loading provided by the nozzle chamber but also the steam pressure load (3600 Psi) on its bottom and left faces. This load combination provides great radial sealing at this location.

This arrangement facilitates the sliding and motion of the inlet conduit while maintaining the seal. Tolerance to axial and transverse motion is also improved, since the separate rings, with increased resistance to oxide buildup, slide relative to each other more easily, preventing deformation and resulting leakage.

Crowning (i.e. slightly curving) the inner and outer rings at their sealing surfaces may prove beneficial since it will provide positive sealing stability rather than relying on highly smooth surface finishes to prevent steam leakage. Depending on the expected wear life of the seal as a system, the same level of sealing may be achieved with one inner (i.e. first existing inner ring) and two outer (i.e. first and second existing outer ring) seal rings where the second inner and third outer rings become integral parts of the ring carrier.

The material of the seal ring carrier is A-286 or similar steel, or super alloy which has a large coefficient of thermal expansion of approximately ($9.0\times10^{-6}$), reduced coefficients of friction, and reduced rates of oxidation.

The seal ring carrier is designed to allow the nut to be easily threaded into the inlet conduit during assembly and disassembly and, due to the coefficient of expansion to be tightly locked at operating temperature. The material is also highly resistant to oxidation.

The sealing rings are fitted to the seal ring carrier, with the inner rings being made of 422SS or similar steel which has a lower coefficient of thermal expansion of approximately ($6.0\times10^{-6}$). As the temperature increases during start up, the carrier with the high growth rate expands into the inner rings with the lower growth rate causing a tight seal between the carrier and the inner rings.

The outer seal rings are made from A-286 or similar steel, while the nozzle chamber is made from CR-MO-V. Here the seal ring grows at a more rapid rate than the nozzle bore, forming a tight seal at operating temperature.

The rings must be able to slide in a radial direction to accommodate the thermal gradient, especially during start up and shut down. This is accomplished by use of oxide resistant materials and carefully determining the stack height of the rings. It should be noted that the seal ring carrier, being made of A-286 steel or similar material, will become looser axially as the temperature increases, reducing any tendency of the rings to bind in the axial direction during critical start up/shut down periods when thermal gradients are largest.

The design also is such that the inside diameter of the outer ring is about 0.375 larger than the outside diameter of the carrier. This allows plenty of room for radial movement during thermal transits. The same concept is also applied to the inner ring.

DESCRIPTION OF THE PREFERRED EMBODIMENTS

Figure 1:
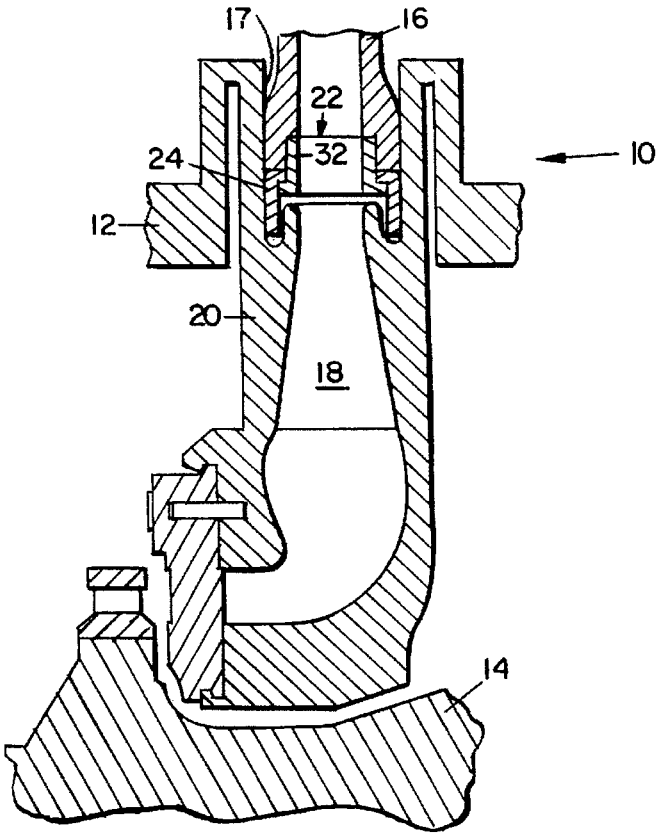
FIG. 1. PRIOR ART
FIG. 1 is a view in longitudinal section of a portion of a steam turbine utilizing a bell seal of the prior art.

Referring to FIG. 1, a longitudinal sectional view of a portion of a steam turbine 10 is illustrated. Turbine 10 includes an outer cylinder, not shown, concentrically surrounding an inner cylinder 12. The outer cylinder and inner cylinder 12 surround a rotor 14.

A main steam inlet conduit 16 extends inwardly from the surface of the outer cylinder toward rotor 14 through an inlet passage 17. A nozzle chamber 18 integral with inner cylinder 12 communicates with inlet passage 17 and has a vertically outwardly extending neck portion 20 which sleeves the innermost portion of the main inlet conduit 16.

A prior art bell seal assembly 22 provides a seal between the lower end of inlet conduit 16 and nozzle chamber 18.

Figure 2:
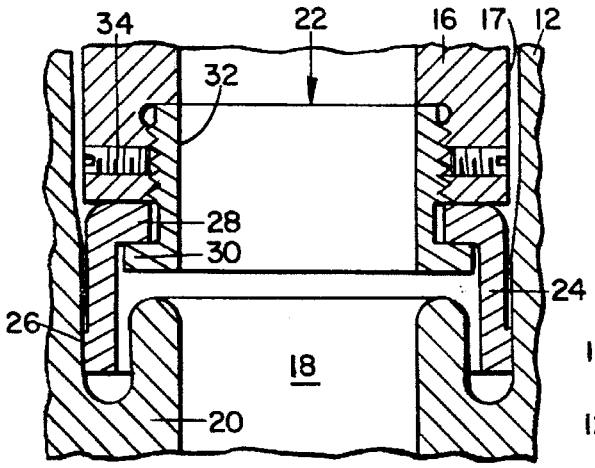
FIG. 2 is an enlarged, fragmentary, longitudinal sectional view of a prior art bell seal of the type shown in FIG. 1.

As best seen in FIG. 2, bell seal assembly 22 includes a bell seal 24 having a lower outwardly extending circumferential flange 26 which contacts the inner wall of inner cylinder 12 and an upper inwardly extending annular flange 28 which rests on a lower circumferential flange 30 of a retainer nut 32 threadedly engaged in the lower end of inlet conduit 16.

Retainer nut 32 is secured against rotation as by locking screws 34 in the lower end of inlet conduit 16.

Figure 3:
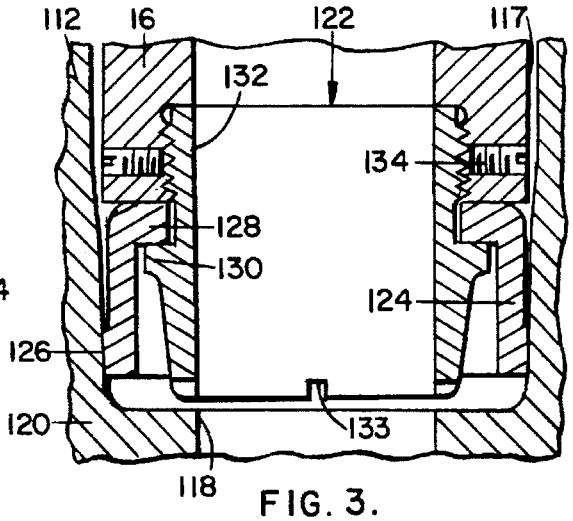
FIG. 3. PRIOR ART
FIG. 3 is an enlarged, fragmentary, longitudinal sectional view of another form of prior art bell seal.

FIG. 3 illustrates another form of prior art bell seal assembly 122 for providing a seal between the lower end of inlet conduit 16 and a nozzle chamber 118 of an inner cylinder 112.

In this instance a neck portion 120 of an inner cylinder 112 is modified as at 117 to accommodate a larger retainer nut 132 which is threadedly engaged in the lower end of conduit 16.

Bell seal assembly 122 includes a bell seal 124 having a lower outwardly extending circumferential flange 126 which contacts the inner wall of inner cylinder 112 and an upper inwardly extending annular flange 128 which rests on a centrally-located circumferential flange 130 of retainer nut 132.

The lower end of retainer nut 132 extends below the plane of bell seal 24 and is slotted as at 133, supposedly to facilitate its installation or removal.

The prior art bell seal assemblies 22 and 122 of FIGS. 2 and 3 respectively are designed to allow for 0.25 to 0.5 percent leakage between the seal assembly and inlet conduit 16.

The reason for this design leakage is to allow for assembly of the components, that is, there is a 0.002 to 0.003 radial clearance between the seal assemblies 26 and 126 and the inner cylinders 12 and 112 respectively. There is also a 0.003 to 0.004 clearance by design between retainer nuts 32 and 132 and bell seal assemblies 22 and 122 respectively. This clearance is to allow for radial movement between the nozzle chamber and the inlet conduit that occurs because of the thermal transits during start up and shutdown of the turbine.

Retainer nuts 32 and 132 are typically made from CR/MO. Although this material has adequate strength, it is highly susceptible to oxide buildup, thus making it impossible or nearly impossible to remove the nuts by unscrewing in the normal fashion. The nuts, in most instances, must be cut out, a very difficult and time consuming process.

Bell seals 24 and 124 are typically made from Stellite-6 which is a highly erosion resistant and tough material. The nozzle chambers 18 and 118 are typically made from CR/MO which is a relatively soft and malleable steel and susceptible to oxide buildup. After operating in a harsh environment for several years the seals are very difficult to separate without galling the nozzle box during disassembly. When galling does occur it becomes necessary to machine the nozzle chamber, a very time consuming and expensive operation.

The problems encountered with the prior art bell seal assemblies are avoided with the expanding bell seals of the invention.

Figure 4:
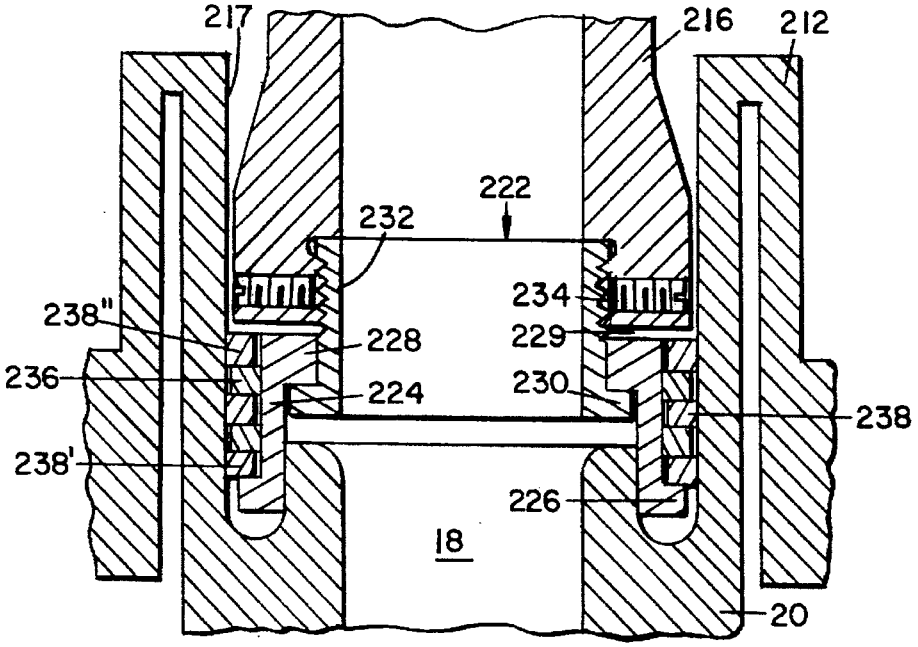
FIG. 4 is an enlarged, fragmentary, longitudinal sectional view of an expanding bell seal embodying one form of the invention.

In FIG. 4, a bell seal assembly 222 of the invention replaces the prior art bell seal assemblies 22 and 122 of FIGS. 2 and 3 respectively.

Bell seal assembly 222 includes a ring carrier 224 having a lower outwardly extending circumferential flange 226 having its outer periphery spaced inwardly from the inner wall of inlet passage 217 and an upper inwardly extending annular flange 228 which rests on a lower circumferential flange 230 of a retainer nut 232 threadedly engaged in the lower end of an inlet conduit 216.

Retainer nut 232 is secured against rotation as by locking screws 234 in the lower end of inlet conduit 216.

A stack of alternating inner rings 236 and outer rings 238 is sleeved on ring carrier 224, with a lowermost outer ring 238' resting on lower flange 226 of the ring carrier and with an uppermost outer ring 238" being disposed in close proximity to, but spaced from, the lower end of inlet conduit 216, for providing appropriate clearance as at 229 to allow freedom of movement.

The inner diameter of inner rings 236 is slightly larger than the outer diameter of ring carrier 224 and the outer diameter of outer rings 238 is slightly smaller than the inner diameter of an inlet passage 217 in an inner cylinder 212. The combined axial dimension of alternating inner rings 236 and outer rings 238 is slightly less than the dimension between flange 226 and the top of ring carrier 224.

The inner and outer rings fit loosely at assembly and disassembly, seal tightly during operating conditions and have material properties which limit oxide buildup. This arrangement further facilitates the sliding motion of inlet conduit 216 while maintaining the seal. Tolerance to axial and transverse motion is also improved, since the separate rings, with increased resistance to oxide buildup, slide relative to each other more easily, preventing deformation and resulting leakage.

The rings are made from a high strength super alloy which resists oxidation and is hard enough to be resistant to galling and fretting.

The material of ring carrier 224 is A-286 or similar steel, a super alloy which has a large coefficient of thermal expansion ($9.0\times10^{-6}$).

Ring carrier 224 is designed with clearance to allow retainer nut 232 to be easily threaded into inlet conduit 216 during assembly and disassembly and, due to the coefficient of expansion to be tightly locked at operating temperature. The material is also highly resistant to oxidation.

The sealing rings are fitted to ring carrier 224, with inner rings 236 being made of 422SS steel or similar material which has a lower coefficient of thermal expansion ($6.0\times10^{-6}$). As the temperature increases during start up, ring carrier 224, with the high growth rate expands into inner rings 236 with the lower growth rate causing a tight seal between ring carrier 224 and inner rings 236.

Outer seal rings 238 are made from A-286 or similar steel, while inlet passage 217 is made from CR-MO-V. Here, outer seal rings 238 grow at a more rapid rate than inlet passage 217, forming a tight seal at operating temperature.

Inner and outer rings 236 and 238 respectively must be able to slide in a radial direction to accommodate the thermal gradient, especially during start up and shut down. This is accomplished by use of oxide resistant materials and carefully determining the stack height of the rings. It should be noted that ring carrier 224, being made of A-286 or similar material, will become looser axially as the temperature increases, reducing any tendency to bind during critical start up/shut down periods when thermal gradients are largest.

The design also is such that the inside diameter of outer rings 238 is about 0.375 larger than the outside diameter of ring carrier 224. This allows plenty of room for radial movement during thermal transits. The same concept is also applied to inner rings 236.

Figure 5:
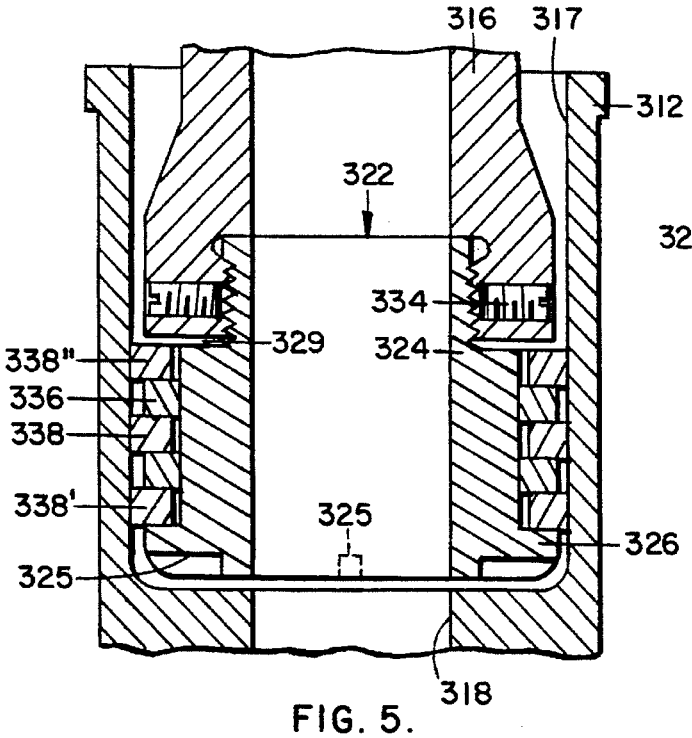
FIG. 5 is an enlarged, fragmentary, longitudinal sectional view of an expanding bell seal embodying a first modified form of the invention.
Figure 6:
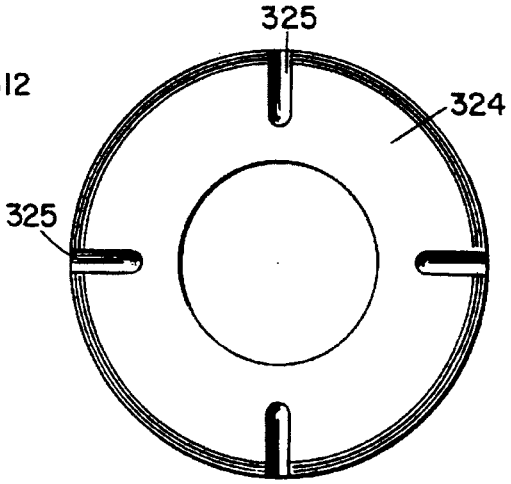
FIG. 6 is a bottom plan view of the retaining nut of the bell seal of FIG. 5.

In FIGS. 5 and 6, a first modified seal carrier assembly 322 of the invention replaces the prior art bell seal assembly 122 of FIG. 3.

In ring carrier 322, retainer nut 132 and bell seal 124 of prior art bell seal assembly 122 are replaced by a somewhat bell-shaped unitary ring carrier 324 which is threadedly engaged in the lower end of an inlet conduit 316.

Inlet conduit 316 extends into an inlet passage 317 of an inner cylinder 312 which communicates with a nozzle chamber 318.

Ring carrier 324 has a lower outwardly extending circumferential flange 326 having its outer periphery spaced inwardly from the inner wall of inlet passage 317.

Ring carrier 324 is secured against rotation as by locking screws 334 in the lower end of inlet conduit 316.

Threaded engagement of ring carrier 324 with inlet conduit 316 is facilitated by the provision of tool engaging slots 325 in the lower face of the ring carrier.

A stack of alternating inner rings 336 and outer rings 338 is sleeved on ring carrier 324, with a lowermost outer ring 338' resting on lower flange 326 of the ring carrier and with an uppermost outer ring 338" being disposed in close proximity to, but spaced from, the lower end of inlet conduit 316, for providing appropriate clearance as at 329 to allow freedom of movement.

The inner diameter of inner rings 336 is slightly greater than the outer diameter of ring carrier 324 and the outer diameter of outer rings 338 is slightly smaller than the inner diameter of inlet passage 317 of inner cylinder 312. The combined axial dimension of alternating inner rings 336 and outer rings 338 is slightly less than the dimension between flange 335 and the top of ring carrier 324.

The inner and outer rings fit loosely at assembly and disassembly, seal tightly during operating conditions and have material properties which limit oxide buildup. This arrangement further facilitates the sliding motion of inlet conduit 316 while maintaining the seal. Tolerance to axial and transverse motion is also improved, since the separate rings, with increased resistance to oxide buildup, slide relative to each other more easily, preventing deformation and resulting leakage.

As with the embodiment of FIG. 4, the rings are made from a high strength super alloy which resists oxidation and is hard enough to be resistant to galling and fretting.

The material of ring carrier 324 is A-286 or similar steel, a super alloy which has a large coefficient of thermal expansion ($9.0\times10^{-6}$).

Ring carrier 324 is designed with clearance to allow it to be easily threaded into inlet conduit 316 during assembly and disassembly and, due to the coefficient of expansion to be tightly locked at operating temperature. The material is also highly resistant to oxidation.

The sealing rings are fitted to ring carrier 324, with inner rings 336 being made of 422SS or similar steel which has a lower coefficient of thermal expansion ($6.0\times10^{-6}$). As the temperature increases during start up, ring carrier 324 with the high growth rate expands into inner rings 336 with the lower growth rate causing a tight seal between ring carrier 324 and inner rings 336. Outer seal rings 338 are made from A-286 or similar steel, while inlet passage 317 is made from CR-MO-V. Here outer seal rings 338 grow at a more rapid rate than inlet passage 317, forming a tight seal at operating temperature.

Inner and outer rings 336 and 338 respectively must be able to slide in a radial direction to accommodate the thermal gradient, especially during start up and shut down. This is accomplished by use of oxide resistant materials and carefully determining the stack height of the rings. It should be noted that ring carrier 324, being made of A-286 steel or similar material, will become looser axially as the temperature increases, reducing any tendency to bind during critical start up/shut down periods when thermal gradients are largest.

The design also is such that the inside diameter of outer rings 338 is about 0.375 larger than the outside diameter of ring carrier 324. This allows plenty of room for radial movement during thermal transits. The same concept is also applied to inner rings 336.

Figure 7:
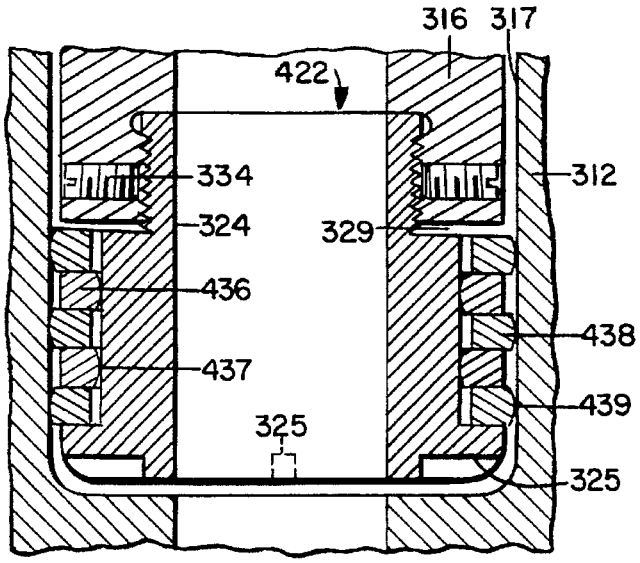
FIGS. 7–9 are enlarged, fragmentary, longitudinal sectional views of expanding bell seals embodying second, third and fourth modified forms respectively of the invention.

In FIG. 7, a second modified seal carrier assembly 422 of the invention replaces the prior art bell seal assembly 122 of FIG. 3.

Bell seal assembly 422 of FIG. 7 is identical in all respects to first modified seal carrier assembly of FIGS. 5 and 6 with the added improvement of "crowning", i.e. slightly curving, inner seal rings 436 and outer seal rings 438 at their sealing surfaces.

The inner diameters of inner seal rings 436 are crowned as at 437, while the outer diameters of outer seal rings 438 are crowned as at 439.

Such crowning of the inner and outer rings at their sealing surfaces may prove beneficial since it will provide positive sealing stability rather than relying on highly smooth surface finishes to prevent steam leakage.

Figure 8:
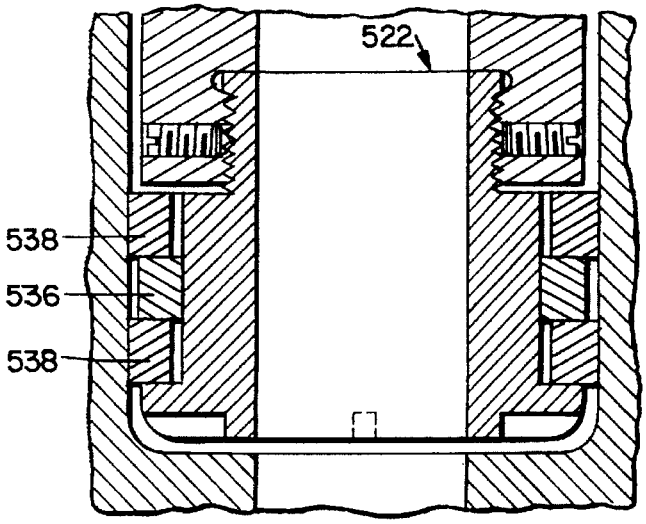

Depending on the expected wear life of the seal as a system, the same level of sealing may be achieved with one inner (i.e. first existing inner ring) and two outer (i.e. first and second existing outer ring) seal rings as shown in the third modified seal carrier assembly 522 of FIG. 8, wherein a single inner seal ring 536 is sandwiched between a pair of outer seal rings 538.

Figure 9:
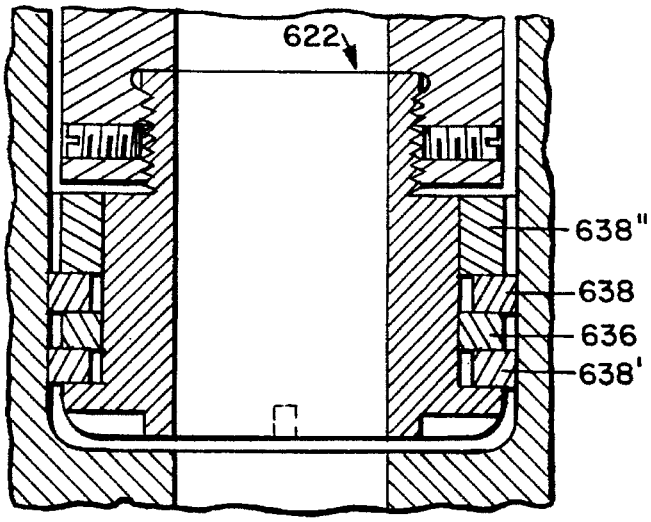

In the fourth modified seal carrier assembly 622 of FIG. 9, an upper spacer ring 638" replaces outer seal ring 338" and upper inner seal ring 336 of FIG. 5, with spacer ring 638" resting on a trio of alternating outer and inner seal 638, 636 and 638', respectively.

We claim:

1. In a steam turbine having a main inlet pipe which introduces steam to a nozzle chamber through the turbine casings and a bell seal assembly for sealing the inlet pipe relative to the casings and the nozzle chamber, the bell seal assembly including a bell seal disposed in the nozzle chamber, and a retaining nut sleeved by the bell seal and threadedly engaged in the inlet pipe, the improvement which comprises a ring carrier replacing the bell seal, a stack of inner and outer sealing rings loosely sleeved on the ring carrier, with a lowermost ring resting on a lower flange of the ring carrier and with an uppermost ring being disposed in close proximity to the lower end of the inlet pipe, the inner diameter of the inner rings being slightly larger than the outer diameter of the ring carrier and the outer diameter of the outer rings being slightly smaller than the inner diameter of the nozzle chamber, the inner rings being made from a high strength super alloy which resists oxidation having a lower coefficient of thermal expansion than the material of the ring carrier, and the outer rings being made from a high strength super alloy which resists oxidation having a higher coefficient of thermal expansion than the material of the nozzle chamber wherefore, as the temperature increases during turbine start up the ring carrier expands into contact with the inner rings forming a tight seal therebetween at operating temperature and the outer rings expand into contact with the nozzle chamber forming a tight seal therebetween at operating temperature.

2. In a steam turbine according to claim 1, wherein the ring carrier and retainer nut are formed as an integral unit threadedly engaged with the inlet pipe and having the inner and outer sealing rings loosely sleeved thereover.

3. In a steam turbine according to claim 1, wherein the ring carrier is made from A-286 steel and the inner sealing rings are made from 422SS steel.

4. In a steam turbine according to claim 1, wherein the outer sealing rings are made from A-286 steel and the nozzle chamber is made from CR-MO-V.

5. In a steam turbine according to claim 1, wherein the inner and outer sealing rings are crowned at their sealing surfaces.

* * * * *